US006766848B2

(12) United States Patent
Cheng

(10) Patent No.: US 6,766,848 B2
(45) Date of Patent: Jul. 27, 2004

(54) SHOWER CURTAIN EFFECTIVELY ISOLATING SHOWER AREA FROM BATHROOM

(76) Inventor: Wen-Ping Cheng, 235 Chung-Ho, Box 8-24, Taipei (TW)

( * ) Notice: Subject to any disclaimer, the term of this patent is extended or adjusted under 35 U.S.C. 154(b) by 4 days.

(21) Appl. No.: 10/192,799

(22) Filed: Jul. 11, 2002

(65) Prior Publication Data

US 2004/0007335 A1 Jan. 15, 2004

(51) Int. Cl.[7] ..... A47K 3/36
(52) U.S. Cl. ..... 160/330; 160/349.1
(58) Field of Search ..... 160/330, DIG. 6, 160/179, 327, 354, 368.1, 349.1, 349.2; 4/558, 608

(56) References Cited

U.S. PATENT DOCUMENTS 2,608,250 A * 8/1952 Meyer ..... 160/349.2
4,769,862 A * 9/1988 Skrzelowski ..... 4/610
6,591,432 B1 * 7/2003 Feinstein et al. ..... 4/558

* cited by examiner

*Primary Examiner*—Blair M. Johnson

(57) ABSTRACT

A shower curtain has a large curtain area made of waterproof material. A top of the shower curtain is formed with a plurality of through holes which are arranged transversally; thereby, the shower curtain being fixed to and slidable along a specific fixing rod. Two sides of the shower curtain are formed with special compound edges. The material of the compound edge are plastic thin films which are adhered to the shower curtain by high frequency, supersonic waves and seaming. The plastic thin film is a hydrophile material and thus it has an adhesion force to an attached wall. Therefore, the shower curtain is adhered to a wall surface to isolate a shower area from a bath room.

1 Claim, 4 Drawing Sheets

SHOWER CURTAIN EFFECTIVELY ISOLATING SHOWER AREA FROM BATHROOM

BACKGROUND OF THE INVENTION

1. Field of the Invention

The present invention relates to shower curtains, and particularly to a shower curtain two sides of which can be adhered to the wall surface temporarily as the shower curtain is used. Thereby, water will not splash everywhere.

2. Description of the Related Art

A conventional shower curtain (as shown in FIG. 1) includes a main body composed of water-proof material. The main body has a plurality of holes which are arranged to a fixing rod in a bathroom. When the curtain is not used, it is folded and placed asides. When the curtain is used, the shower curtain is expanded so as to isolate the water from the outer side.

It seems that this prior art shower curtain is perfect in use, however, when it is analyzed in detail, the user will discover that the prior art shower curtain has some disadvantages necessary to be improved.

1. There are no leak-proof mechanisms on the two sides of this prior art shower curtain, it lacks the function to prevent water from spilling outside when it is expanded for use.
2. In addition to the above mentioned shortcomings which of fail to keep water inside the showering room, it is often that water will splash everywhere on the floor of the bathroom. This may increase the risk of slipping, accidental fall, and injury.

BRIEF DESCRIPTION OF THE INVENTION

The primary objective of this invention is to provide a shower curtain which is installed with special compound layers on two sides of the shower curtain. When the compound layers are wetted, they will form an attaching force temporarily. Thereby, when the shower curtain is expanded, the two sides of the curtain should be fixed precisely so as to have a preferred isolation effect.

BRIEF DESCRIPTION OF DRAWINGS

The drawings of preferred embodiments of the present invention will be described in following in details.

DETAILED DESCRIPTION OF PREFERRED EMBODIMENTS

Figure 1:
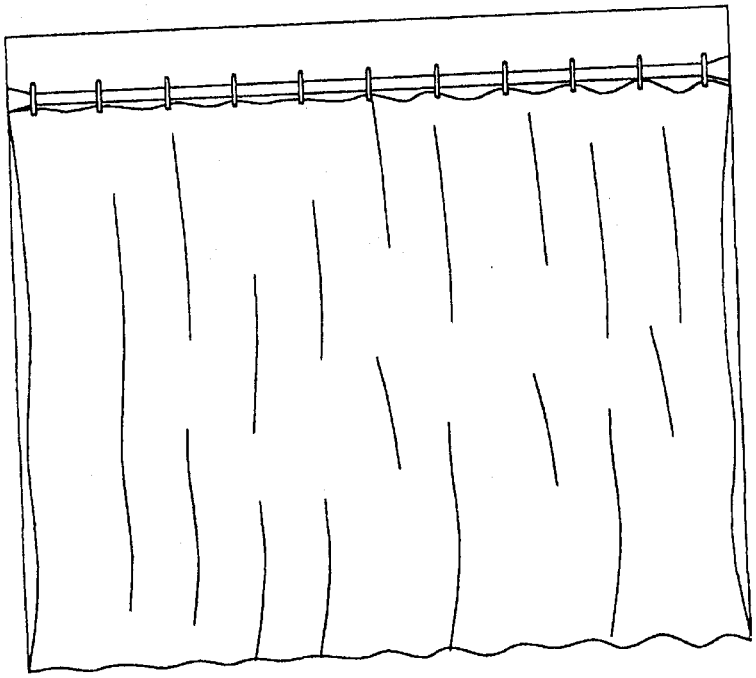
Fig.1 (PRIOR ART)
FIG. 1 is a perspective view of a prior art shower curtain.
Figure 2:
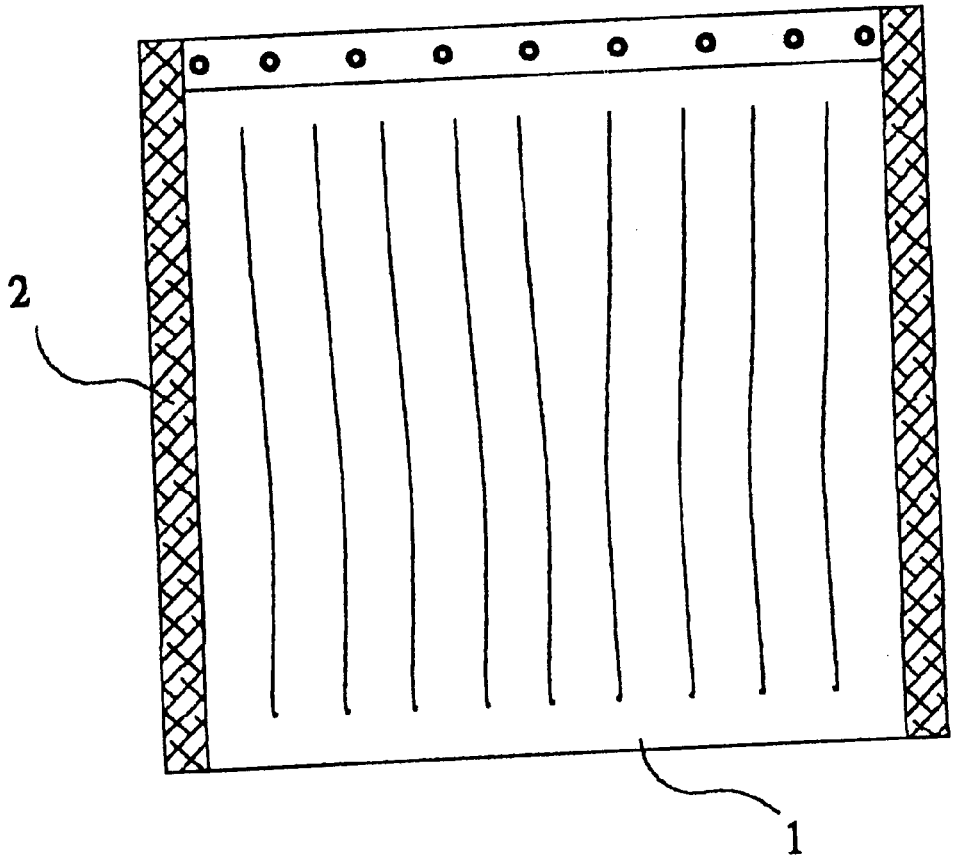
FIG. 2 is a perspective view of the preferred embodiment of shower curtain of the present invention

Referring to FIG. 2, the shower curtain of the present invention is illustrated. The shower curtain has a large curtain area made of water-proof material 1. On the top of the shower curtain is formed with a plurality of through holes which are arranged transversally. Thereby, the shower curtain can be fixed to and slidable along a specific fixing rod. However, the above mentioned structure is used in the prior art shower curtain, and thus the details will not be further described herein.

As shown in FIG. 2, the two sides of the shower curtain are formed with special compound edges. The material of the special compound edges are plastic thin films which are adhered to the shower curtain by high frequency, supersonic waves and seaming. The plastic thin film is a hydrophile material and thus it has an adhesion force. Therefore, the shower curtain can be adhered to the wall surface to present an isolation effect.

Figure 4:
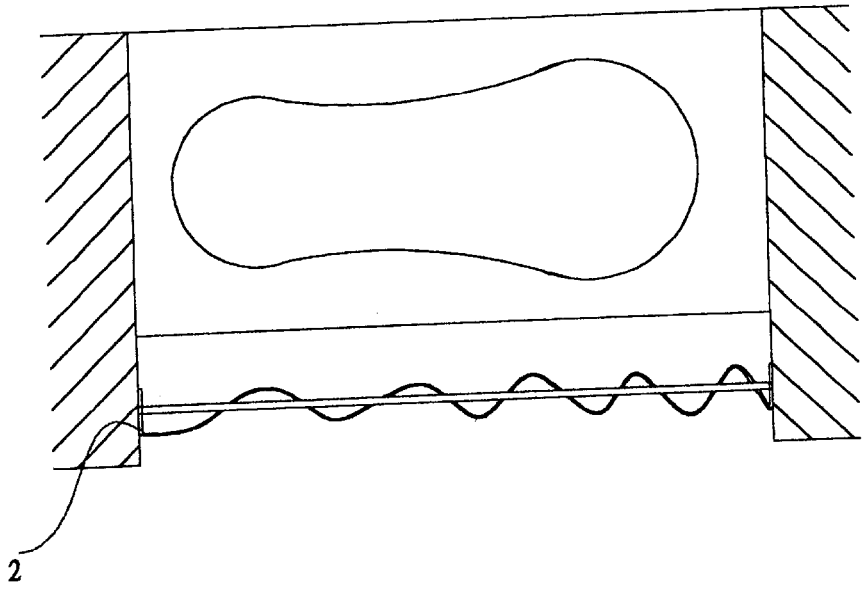
FIG. 4 shows one preferred embodiment of the present invention, where the application of the present invention is illustrated.

With reference to FIG. 4, when the shower curtain is not used, the shower curtain is firstly suspended from a fixing rod in the bathroom.

Figure 3:
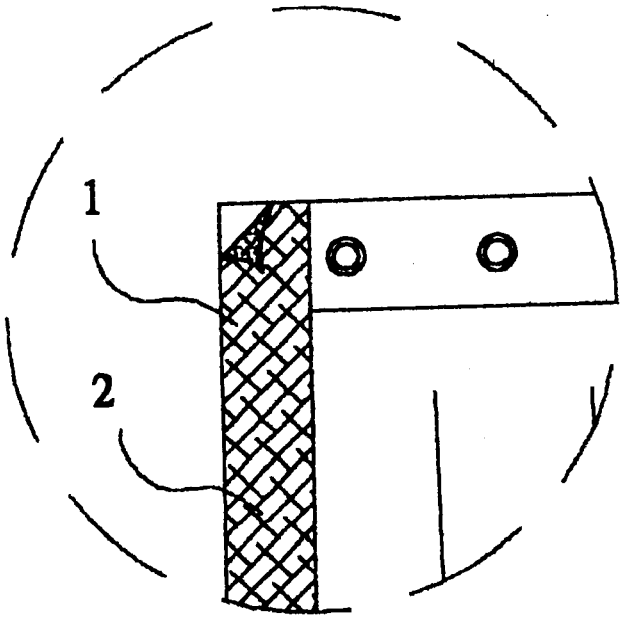
FIG. 3 shows corner details of the preferred embodiment of the present invention.

FIG. 3 shows a corner detail which show the thin plastic film as a separate piece from the shower curtain. When the shower curtain is used, one side of the shower curtain having the compound edge is adhered to the wall of the shower room. Then, the shower curtain is expanded toward another side of the wall and then is adhered to the wall. In another way, the shower curtain is expanded from the two edges toward to two sides, and then the two sides are adhered to the wall so that the shower curtain is positioned. Thus, the shower curtain has the effect of isolating water when the user takes a shower. Thereby, the water will not splash everywhere and the possibility of accidents is reduced greatly.

The plastic thin film in the compound edge has an adhering effect as it is wet. Thereby, when the plastic thin film is used in a bathroom, the vapor in the bathroom will wet the compound edge so as to generate an adhesion effect to have a preferred isolation effect.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A shower curtain having a large curtain area made of water-proof material, a top of the shower curtain being formed with a plurality of through holes which are arranged transversally; thereby, the shower curtain being fixed to and slidable along a fixing rod;

characterized in that:

each of two lateral sides of the shower curtain from the top to the bottom of the shower curtain is formed with a respective special compound edge; the material of the compound edge is plastic thin film which is adhered to the shower curtain by high frequency, supersonic waves and seaming; the plastic thin film is a hydrophile material and thus it has an adhesion force to attach to a wet wall surface; therefore, the shower curtain is adhered to a wet wall surface to isolate a shower area from a bath room.

* * * * *